United States Patent [19]

Braun

[11] 3,950,106

[45] Apr. 13, 1976

[54] EMBOUCHURE PEN

[76] Inventor: Ben Braun, 15 Georgia Drive, Syosset, N.Y. 11791

[22] Filed: Jan. 7, 1975

[21] Appl. No.: 539,056

[52] U.S. Cl. ..... 401/256; 401/261

[51] Int. Cl.[2] ..... B43K 17/00

[58] Field of Search ..... 401/264–267, 401/256, 238, 239, 232, 221, 222, 261, 231

[56] References Cited

UNITED STATES PATENTS

| | | | |
|---|---|---|---|
| 544,179 | 8/1895 | Kline | 401/221 |
| 578,834 | 3/1897 | Robinson | 401/221 |
| 1,333,034 | 3/1920 | Nawn | 401/256 X |
| 2,753,845 | 7/1956 | Meissner | 401/261 |
| 3,871,776 | 3/1975 | Braun | 401/256 |

FOREIGN PATENTS OR APPLICATIONS

| | | | |
|---|---|---|---|
| 344,252 | 10/1920 | Germany | 401/256 |

*Primary Examiner*—Lawrence Charles

[57] ABSTRACT

A pen of improved writing range, differentiated primarily in that it has a flexible capillary mouth of continuous, annular, free shape which can be reformed by writing pressure into an embouchure slit in all axial writing positions. The writing quality of the pen is determined by the shape of the lips forming the embouchure. By this means, point curvature and point pressure may be utilized in different degrees to produce various forms of lines to fill a particular writing, drawing, or lettering need.

10 Claims, 12 Drawing Figures

Fig. 7
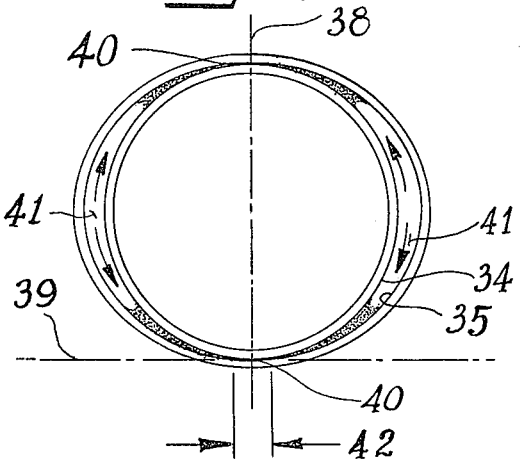
Fig. 8
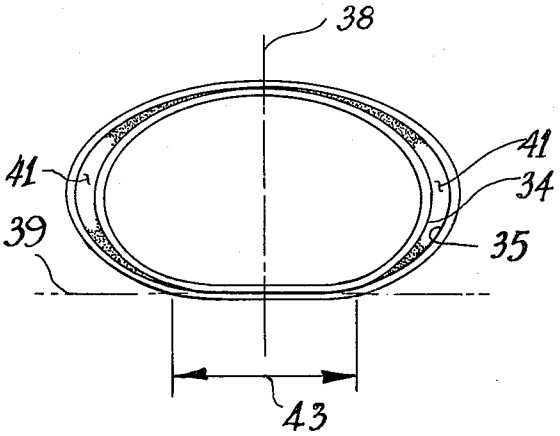
Fig. 10
Fig. 9
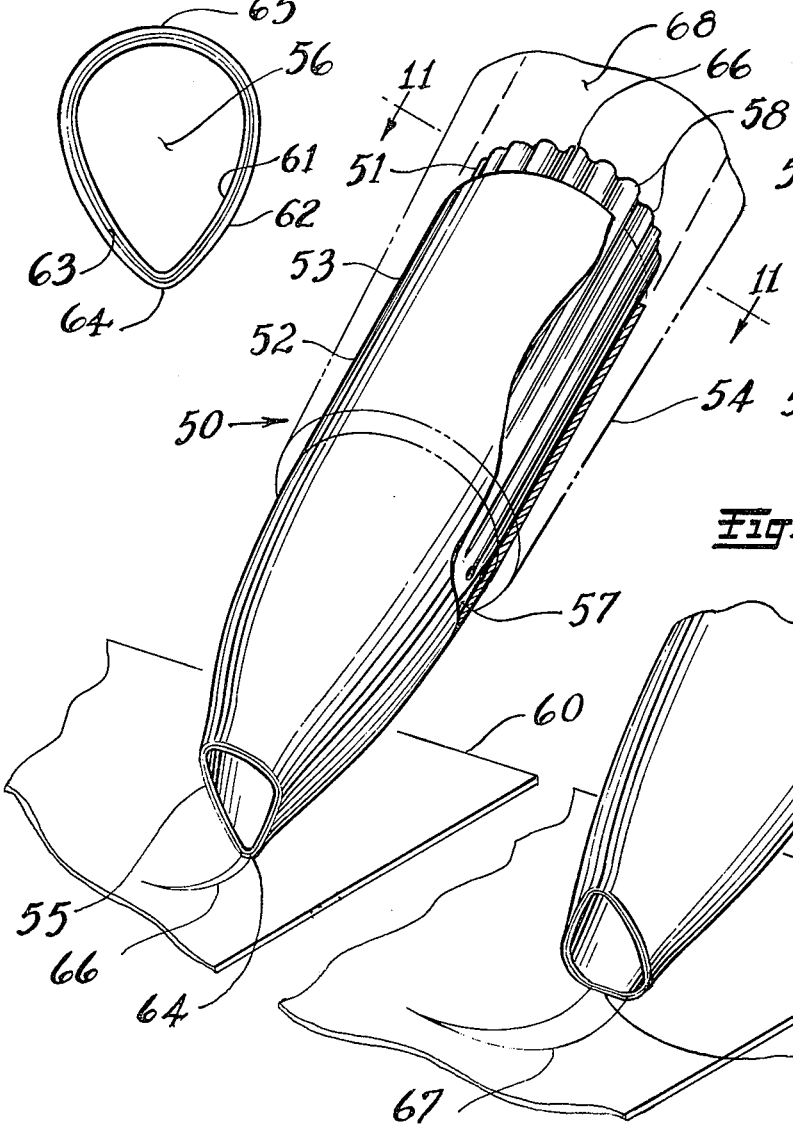
Fig. 11
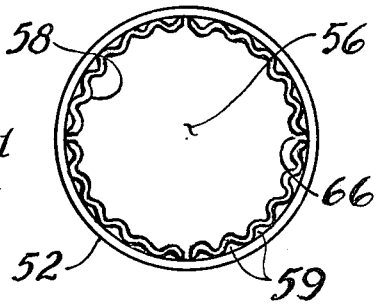
Fig. 12
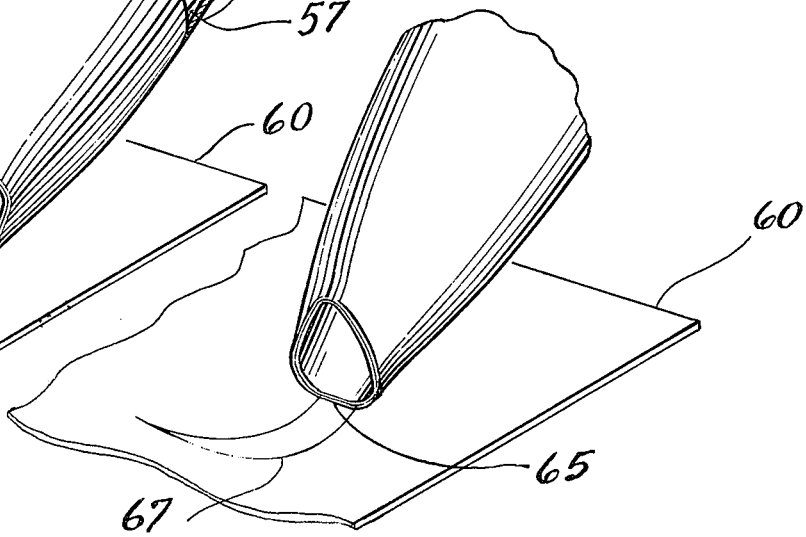

EMBOUCHURE PEN

FIELD OF THE INVENTION

This invention relates generally to writing instruments. More specifically, it relates to pens of relatively broad writing range of the type which was already disclosed in my U.S. Pat. No. 3,871,776, filed Mar. 8, 1974.

BACKGROUND OF THE INVENTION

Although contemporary pens make efficient writing instruments, they have the drawback that they provide a relatively small writing range. The ball point pen, for example, is much too rigid to accomodate the writing style of persons who prefer a pen which is flexible and spreads under writing pressure in order to provide variation in the width of the written line, thus personalizing the style of the writing. Some pens currently in use have tips made of felt or other fibrous material to provide such flexibility. However, these tips tend to deteriorate rapidly due to the low abrasion resistance of these materials. It is also disconcerting to find that the new pens generally lack the aesthetic writing qualities of the earlier pen forms.

While the traditional flexible point provides a fairly extensive writing range, it is frequently found objectionable for reasons largely relating to its ink feeding slit. These pen points have two opposed nibs which define a slit or juncture therebetween to serve as a channel for ink. When this pen is subjected to writing pressure, the nibs separate at their tips, reducing thereby the capillary potential where it is most needed. Consequently, ink withdraws from the tip of the pen and causes it to write scratchy lines. Moreover, excessive spreading of the nibs makes the maintenance of wetness therebetween for instantaneous writing more difficult and sometimes renders the feed channel inoperative by causing permanent nib deformation or breakage. Another disadvantage of this pen which militates against its use is its sharply-pointed nibs which have a strong tendency to scratch and penetrate the paper surface on the upstroke of the pen.

In another type of pen point, previously disclosed in my U.S. Pat. No. 3,871,776, the above-mentioned drawbacks are eliminated by arranging the nibs so that their tips become progressively more contiguous instead of more divergent with the application of writing pressure thereon.

SUMMARY OF THE INVENTION

It is therefore a principal object of the present invention to provide a pen of the above type which also offers improved writing characteristics and materially extends the writing range of the pen.

This object is accomplished mainly by providing the pen with a continuous annular writing and portion which affords the user many new advantages, one outstanding feature thereof being that the pen can now be axially rotated to any writing position.

Another feature of the present invention is the provision of such a pen which may be used in the art of drawing, lettering, calligraphy, and the like.

Still another feature of the present invention is the provision of such a pen with a dual writing capability in that it can produce both constant-width lines and variable-width lines.

Yet still another feature of the present invention is the provision of such a pen whereby the shading characteristics thereof may be varied both by variable point curvature and by variable point pressure.

A further feature of the present invention is the provision of such a pen which will glide easily over a paper writing surface.

Yet still another further feature of the present invention is the provision of such a pen which is durable, simple in construction and easy to manufacture.

The objectives of the invention are accomplished by nesting two cylindrical body portions so that their forward peripheral ends form respective abuting lips to constitute a writing tip. The pen body thus formed defines an axial through passage which serves as an ink receptacle and vent. It also provides an intermediate ink feeding channel which communicates with the axial passage to deliver ink to the writing tip. In operative use the mouth of the pen forms an embouchure slit which can be varied under pressure by progressive-spring means to produce a line of corresponding breadtn.

By this pen structure there is provided an operative combination which affords a singularly broad range of line widths, ranging in thickness from that of a hairline to that of a stroke virtually exceeding the normal breadth of the tip itself. Moreover, the lips are so arranged with respect to the writing surface as to afford the flexibility comparable to that of a brush and writing fluid may be delivered thereto from a conventional supply or reservoir. Furthermore, writing pressure does not act in a way to disturb the proper capillary feeding relationship between the lips. On the contrary, such pressure only assists in making the lips even more contiguous than before, thus concentrating the capillary forces at the very tip of the pen.

Aside from its broadest aspects, the present invention also comprehends an improved point structure which serves many special needs. In producing rythmic thick-and-thin lines with uniform writing pressure, it performs the functions of a calligraphic pen. Of course, it can also be used with variable writing pressure to write continuously variable lines. In another writing position the embouchure pen can be used to produce lines of constant width and generally serve the purposes of a so-called technical pen.

These and other objects and advantages of the present invention will become more evident from the following specification in connection with the accompanying drawings, in which:

BRIEF DESCRIPTION OF THE DRAWINGS

FIG. 7 is a schematic view of the mouth of the pen point under relatively light pressure.

FIG. 8 is a schematic view of the same under relatively greater pressure.

FIG. 9 is a perspective view of another embodiment of the invention in which the mouth of the pen point is shown to have a non-circular configuration.

FIG. 10 is a front view of the pen point shown in FIG. 9.

FIG. 11 is a transverse section of the pen point taken on line 11—11 of FIG. 9.

FIG. 12 is another perspective view of the pen point shown in FIG. 9, except that it has been rotated 180° on its longitudinal axis.

DESCRIPTION OF THE PREFERRED EMBODIMENTS

Figure 1:
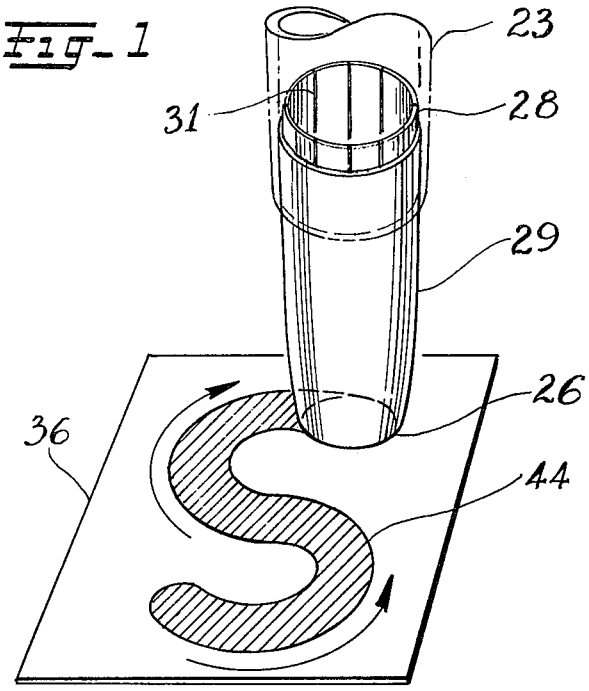
FIG. 1 is a perspective view of the present embodiment of the invention, positioned for strokes of uniform line width.

Although the embouchure point may have any suitable cross-sectional shape, it will be described first for simplicity in connection with the circular shape shown in FIGS. 1 through 6. Here, the pen generally designated 20 is shown to comprise a substantially cylindrical pen body 21 which is formed of resilient material, such as spring metal or plastic, the latter being generally preferred because it relates more closely to the physical properties of the natural quill. The pen body 21 has a rear shank end part 22 which is adapted to fit into the bore of a pen barrel 23 and a forward mouth end part 24 which forms a writing tip 26. A feed channel 27 is provided to deliver ink thereto for transfer onto a paper writing surface 36. It is understood that the pen barrel 23 is equipped with an ink passage 33 leading to a conventional supply or reservoir (not shown) which may be of the usual ink-elevating or cartridge type.

Now, considering the structure just described in somewhat greater detail, the pen is further shown in the same figures to comprise a pair of substantially cylindrical or quill-shaped body portions 28 and 29 of graduated diameters which are nestingly disposed and constitute respective inner and outer portions of the pen body 21. The two body portions 28 and 29 are transversely junctured along the shank end thereof and extend freely therefrom to form at their forward ends respective abuting lips 34 and 35 to constitute a writing tip 26. In this conjoint relationship, they define a longitudinally-extending axial passage 30 to serve as a vent opening and a small intermediate space 27 of annular cross-section to provide a feed channel for ink. The feed channel 27 tapers forwardly and opens out between the lips 34 and 35 in a transversely continuous capillary juncture 25, shown in FIG. 4 to be substantially circular in free shape. The lips are preferably made transversely more flexible than the rest of the pen body to provide the proper tactile qualities for writing and drawing purposes. Any suitable joining means, such as, friction, adhesive, or spot welding, may be used to secure the two body portions together.

Of course, it will be necessary to arrange for the delivery of writing fluid from the ink passage 33 of the pen barrel to the intermediate channel 27 of the pen point. This is easily accomplished by providing longitudinal slits 31 circumferentially equispaced about the junctured end of inner body portion 28. The slits serve as ink ducts and define a plurality of tongues 32 which perferably extend further rearwardly into the ink passage than the corresponding end of outer body portion 29 to draw ink more easily therefrom as needed. Naturally, the same function could also be effected through the use of ribs, grooves, web structures, and the like, in lieu of slits. However, the use of slits provides channel 27 direct access to the axial passage 30 which forms an extension of the ink passage 33. To alleviate stresses in the material, the slits preferably terminate in pierces 37 at the juncture thereof with channel 27.

It will be noted that the outer body portion 29 can also be made relatively longer than the inner portion and suitably capped at the upper end thereof to provide the pen with its own holder, if so desired. While the axial passage 30 is nominally a vent, it also constitutes an ink receptacle which holds substantial amounts of writing fluid and the pen can be dipped into an ink well, filled by an ink dropper or other appropriate means when it is not equipped with an auxiliary ink supply or reservoir. However, when the pen is provided with a reservoir, the axial passage will be amply large enough to accomodate any displaced fluid resulting from an overpressure in the reservoir and will facilitate the flow of air and liquid back and forth as necessary.

Figure 4:
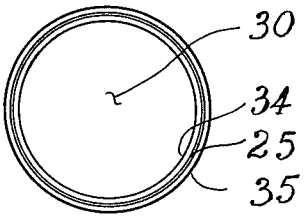
FIG. 4, 5 and 6 are transverse sections of the same pen point taken on lines 4—4, 5—5 and 6—6 of FIG. 3.
Figure 5:
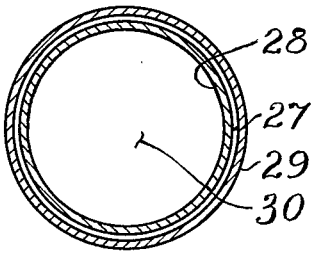
Figure 6:
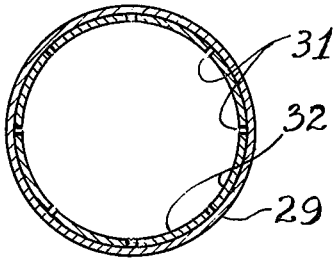

How the present invention achieves its objectives will be readily discerned by applying the following principles in connection with FIGS. 7 and 8, wherein a schematic view of the mouth end of the pen is shown when it is subjected to relatively light and to relatively heavy pressure, respectively. By analogous reference, the lips 34 and 35 are assumed to have substantially the elastic and geometric properties of a pair of flexible rings similarly disposed in free curvature, as shown in FIG. 4. Also, the point of writing contact is defined by the intersection of the chord of contact 38 with a tangent line 39 in the writing plane 36. It will be noted that the representation of these parts has been purposely exaggerated to obtain greater clarity and that the intervening spaces are actually of capillary dimensions.

When writing pressure is applied to the tip of the pen, as shown in FIG. 7, the mouth thereof is accordingly distended to vary the width of the line being written. By this operation, outer lip 35 is deflected to make double contact with inner lip 34, forming thereby two vertices or esculation points 40 along the chord of contact 38 which converts the circular intervening capillary juncture 25 into a pair of meniscus-shaped gaps 41, symmetrically disposed on each side thereof. It will be seen that the confronting edges of lips 34 and 35 constitute substantially respective curves of a conic and an esculating conic. Since liquids tend to flow from areas of larger cross-section to areas of smaller cross-section, any fluid disposed within the meniscus gaps will be drawn by capillary attraction toward the vertices just formed as air enters the gaps 41 to compensate for the displaced fluid. This effect is schematically represented by the two sets of arrows shown in FIG. 7. Referring to FIG. 8, it will be seen that the lips undergo even further deflection with increased writing pressure, becoming more contiguous with each other as well as with the tangent line 39. Thus, the lips constitute, in effect, a progressive-spring means wherein contact between them proceeds gradually outwardly from the esculation point 40, commensurately with the applied pressure thereon. In this case, of course, it is only the lower esculation point which actually constitutes the writing tip.

The rectified portion of the capillary mouth 25 forms a cross-slit as the lips thereof approach zero curvature which is herein characterized as an embouchure and defines accordingly the breadth of the ensuring ink track. Thus, when relatively light pressure is applied to the pen, the effective embouchure will be substantially the point of tangency of the tip in free curvature producing thereby a relatively thin line 42, as shown in FIG. 7. When relatively heavy pressure is applied thereto, the embouchure will be accordingly distended producing thereby a relatively broad line 43, as shown in FIG. 8.

It will be noted that even when the lips are greatly distended, they still retain their proper capillary feeding relationship at all times under all permissable writing pressures, affording thereby a smooth delivery of ink to the writing surface.

Since the embouchure point normally produces a relatively heavy line in longitudinal motion and a relatively thin line in transverse motion, it could be generally characterized as a shading pen. The shading qualities of a pen are determined by the breadth-to-thickness relationship of the writing tip. This ratio has been shown in the present instance to be a function of the curvature of the tip and the applied pressure thereon. A point of circular free shape is axially symmetrical to the pen and provides a tip of constant curvature, irrespective of the rotation thereof; therefore, the shading qualities can only be modified by writing pressure. Hereinafter, another embodiment of the invention will be described wherein the shading effect is varied by means other than writing pressure.

Figure 2:
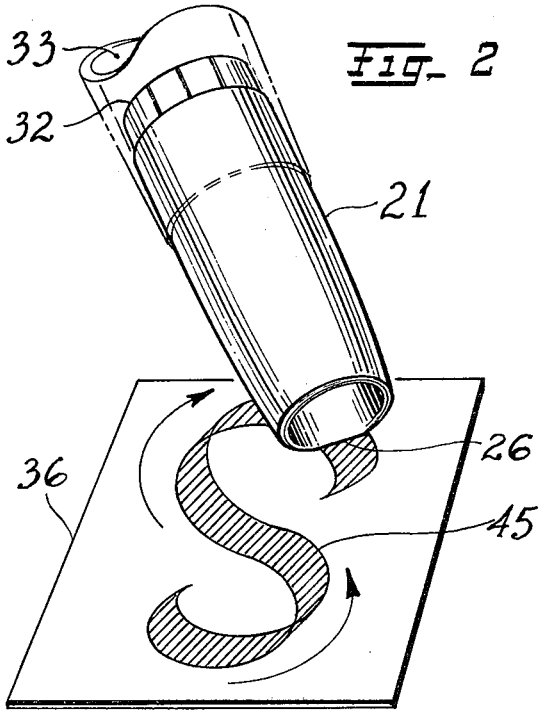
FIG. 2 is a perspective view of the same, positioned for strokes of variable line width.
Figure 3:
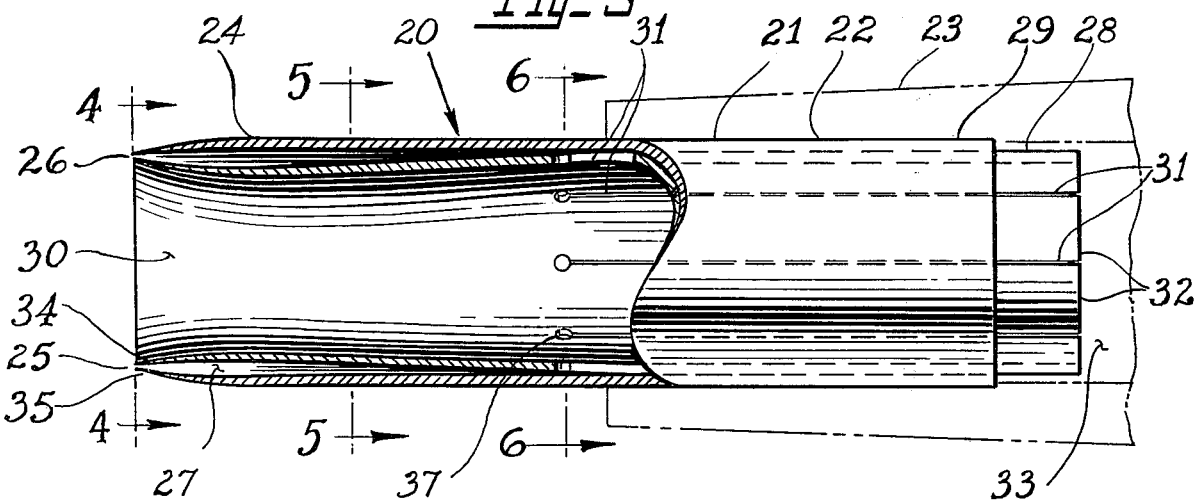
FIG. 3 is a side view of the pen point in which a portion of the forward end has been cut away to show a longitudinal cross-section thereof.

FIGS. 1 and 2 show the present embodiment of the invention disposed in two general writing positions. When the pen is positioned upright, as shown in FIG. 1, and the tip is provided sufficient cross-sectional circularity, a line 44 of constant width will be produced, irrespective of the direction of the stroke. Therefore, this writing position may be utilized for ruling lines, drawing Gothic-Style letters, or for generally performing the functions of a technical pen. However, when the pen is positioned obliquely to the writing surface, as shown in FIG. 2, the written line 45 assumes a thick-and-thin appearance which was already referred to as shading. Thus, the oblique position may be used with uniform writing pressure to produce Roman-Style letters and generally perform the functions of a calligraphic pen, or it may be used with variable writing pressure to produce lines of continuously variable width and generally serve the purposes of a casual writing instrument.

In the form shown and described above, consideration was primarily given to an embouchure point of circular free shape. However, in accordance with the broad principles of the invention, the pen is by no means restricted to this form, nor is it essential that the tip conform in all respects to the cross-sectional shape of the rest of the pen body. To underscore this cardinal point, a modified form of the invention will be described in which the arrangement is quite similar to that previously shown with the exception that the pen now embodies a tip of substantially annular free shape which is other than circular.

Referring to FIGS. 9 through 12, it will be seen that the pen constitutes substantially a cylindrical or quill-shaped nest body 50 comprising an outer portion 52 and an inner portion 51 of slightly reduced diameter which is nestingly disposed there-within. The nest body 50 has a rear shank end part 53 to provide support for the point when it is inserted into the apertured end of a pen barrel 54 and a forward mouth end part 55 to constitute a writing tip. Conjointly, the two body portions define an axial through passage 56 to serve as an ink receptacle with venting means and an intermediate ink feeding channel 57 which communicates therewith to deliver ink to the mouth of the pen for transfer therefrom onto a paper writing surface 60.

To establish communication between the intermediate channel 57 and the ink passage 68 of the pen barrel, the inner portion 51 of the nest body 50 is provided at the rear end thereof with corrugations 58 which form a plurality of cusp-shaped ink ducts 59 therebetween extending longitudinally of the pen body when the two body portions are transversely junctured at the shank end thereof. The inner portion is preferably also provided with slits 66 to effect direct access to the axial passage 56 which is aligned with the ink passage 68.

The mouth 55 of the pen body has a pair of contiguous lips 61 and 62 which constitute the respective forward ends of the body portion 51 and 52. They are arbitrarily represented in the embodiment shown in FIG. 10 as being somewhat egg-shaped in free curvature, defining an upper tip portion 65 having a relatively large circle of curvature and a lower tip portion 64 having a relatively small circle of curvature. The lips 61 and 62 form a corresponding capillary juncture 63 therebetween which constitutes an esculating curve of variable free curvature and defines the mouth of the ink feeding channel 57.

It was shown in the foregoing description how shading was a product of point curvature and point pressure. since the point in question had circular free shape, it possessed constant curvature and the thick-to-thin ratio of the line could only be varied by writing pressure. However, the present embodiment differs from the preceding one in that it provides means whereby the depth or degree of shade imparted to the stroke may be regulated both by variable point curvature and variable point pressure. Again, applying the previous analogy with respect to flexible rings and the observation that under equal pressure larger rings broaden commensurately more than smaller rings, it will be seen by referring to FIG. 9, that when tip portion 64 which has a relatively small circle of curvature is operatively disposed, a line 66 will ensue having relatively light shading imparted thereto; and when tip portion 65 which possesses a relatively large circle of curvature is operatively disposed, as shown in FIG. 12, a line 67 will be produced wherein the shading aspect thereof is markedly more pronounced and bolder than before. Consequently, any intermediate portions of the tip between portions 64 and 65 will likewise produce a shading effect commensurate with its respective point curvature.

It will be noted that the present embodiment of the invention can also be positioned perpendicularly to the writing surface. However, a line formed by this pen is quite different in character from that formed by a pen of the previous construction; that is, instead of producing lines of uniform width, it will produce lines of varying width, changing in their thick-to-thin relationship respective to the direction of movement of the stroke.

From the foregoing remarks it will be apparent that the principles of the invention apply to all types of embouchure points whether they are circular or non-circular, or whether they are disposed symmetrically or asymmetrically about the axis of the pen body. Accordingly, the lips of the embouchure may comprise any combination of differently-shaped portions, such as segments of a conic, which may be integrally connected to form a capillary mouth of continuous annular free shape whereby the pen may be axially rotated to a predetermined writing position to impart its respective shading action upon the line being written. Thus a great variety of shaded characters or letters may be executed with the same pen.

It is, of course, to be understood that the present invention is, by no means, limited to the particular embodiments shown herein, but also comprises any modification within the scope of the appended claims.

I claim:

1. A resilient pen body having two nested body portions defining an ink feeding channel and terminating at their forward ends in respective abuting lips to form an embouchure writing tip wherein the improvement comprises, an embouchure tip for dispensing ink, said tip having two opposed lips defining a continuous capillary juncture therebetween of substantially annular free shape constituting the mouth of said feed channel, a support means for permitting said lips to osculate in response to writing pressure on the pen and for simultaneously reforming said mouth into an embouchure slit for ink tracking action, said lips constituting a progressive-contact spring means for controlling the widening of said slit whereby a corresponding line may be drawn in all writing positions of the pen.

2. A pen as claimed in claim 1, wherein said pen body constitutes substantially a two-cylinder nest transversely junctured at the rear end thereof and said lips constitute substantially flexible rings freely disposed at the forward end thereof.

3. A pen as claimed in claim 1, wherein said pen body comprises an axial through passage and an intermediate space with intercommunicating duct means to provide a vent and a feed channel for the delivery of ink to said tip.

4. A pen as claimed in claim 1, wherein said pen body includes a tongue means disposed rearwardly of said feed channel.

5. A pen as claimed in claim 1, wherein said embouchure slit varies in breadth commensurately with the applied pressure upon said mouth and inversely with respect to the curvature thereof.

6. A pen as claimed in claim 1, wherein said mouth constitutes substantially an osculating circle.

7. A pen as claimed in claim 1, wherein said embouchure tip comprises plural means for forming two gradations of line width for each mouth curvature adjustment and an adjusting means for varying said curvature whereby said gradations may be still further varied to increase or decrease the line width for each said adjustment.

8. A pen as claimed in claim 7, wherein said mouth constitutes substantially a closed osculating curve of non-circular free shape whereby the line width may be varied by axially repositioning the pen.

9. A pen as claimed in claim 7, whrein said mouth constitutes substantially an osculating ellipse.

10. A pen as claimed in claim 7, wherein said mouth comprises a plurality of differently-shaped, integrally-connected, lip portions, said portions constituting substantially respective segments of oscillating conics.

* * * * *